US008939388B1

(12) United States Patent
Beetz et al.

(10) Patent No.: US 8,939,388 B1
(45) Date of Patent: Jan. 27, 2015

(54) METHODS AND APPARATUS FOR LOW HEAT SPRAY DRYING

(75) Inventors: Charles P. Beetz, Erlanger, KY (US); Robert Corbett, Westfield, NJ (US); David Salem, Rapid City, SD (US)

(73) Assignee: ZoomEssence, Inc., Branchburg, NJ (US)

( * ) Notice: Subject to any disclaimer, the term of this patent is extended or adjusted under 35 U.S.C. 154(b) by 610 days.

(21) Appl. No.: 13/245,369

(22) Filed: Sep. 26, 2011

Related U.S. Application Data

(60) Provisional application No. 61/386,762, filed on Sep. 27, 2010.

(51) Int. Cl.
*B05B 5/00* (2006.01)

(52) U.S. Cl.
USPC ..... 239/690; 239/690.1

(58) Field of Classification Search
CPC ..... B05B 5/00; B05B 5/043; B05B 5/0533; B05B 5/087
USPC ..... 239/690, 690.1, 706, 707, 708, 398, 239/422, 428; 159/4.01, 16.3
See application file for complete search history.

(56) References Cited

U.S. PATENT DOCUMENTS

| | | | |
|---|---|---|---|
| 2,954,293 | A | 9/1960 | Rusoff |
| 3,554,768 | A | 1/1971 | Feldman |
| 3,615,723 | A | 10/1971 | Meade |
| 3,655,397 | A | 4/1972 | Parliment et al. |
| 3,677,321 | A | 7/1972 | Felstead |
| 3,679,416 | A | 7/1972 | Reich |
| 3,741,273 | A | 6/1973 | Meade |
| 3,805,869 | A | 4/1974 | Winter et al. |
| 3,817,308 | A | 6/1974 | Bundo |
| 3,840,996 | A | 10/1974 | Grindstaff et al. |
| 3,844,969 | A | 10/1974 | Griffiths et al. |

(Continued)

FOREIGN PATENT DOCUMENTS

| | | | |
|---|---|---|---|
| AU | 549614 | B2 | 2/1986 |
| CA | 1162699 | A | 2/1984 |

(Continued)

OTHER PUBLICATIONS

Jens Thousig Moller, et al., A Primer on Spray Drying, Chemical Engineering, pp. 34-40 (Nov. 2009).

(Continued)

*Primary Examiner* — Davis Hwu
(74) *Attorney, Agent, or Firm* — Hultquist, PLLC; Steven J. Hultquist

(57) ABSTRACT

Methods and apparatus provide for spray drying a liquid product into a dried powder without applying heat, including: forming a slurry including a liquid solvent, a carrier, and an active ingredient; applying an electrostatic charge to the slurry; atomizing the charged slurry to produce a plurality of electrostatically charged, wet particles; suspending the electrostatically charged, wet particles for a sufficient time to permit repulsive forces induced by the electrostatic charge on at least some wet particles to cause at least some of such particles to divide into wet sub-particles; and continuing the suspending step, without the presence of any heated drying fluids, for a sufficient time to drive off a sufficient amount of the liquid solvent within most of the wet particles to leave a plurality of dried particles (the powder), each dried particle containing the active ingredient encapsulated within the carrier.

31 Claims, 11 Drawing Sheets

(56) References Cited

U.S. PATENT DOCUMENTS

| | | | |
|---|---|---|---|
| 3,886,297 | A | 5/1975 | Parliment et al. |
| 3,920,815 | A | 11/1975 | Harvey et al. |
| 3,956,521 | A | 5/1976 | Pisecky |
| 3,962,321 | A | 6/1976 | Parliment et al. |
| 3,962,384 | A | 6/1976 | Cannalonga et al. |
| 3,963,559 | A | 6/1976 | Petersen et al. |
| 3,966,975 | A | 6/1976 | Hansen |
| 4,001,437 | A | 1/1977 | Jaeggi |
| 4,032,465 | A | 6/1977 | Bauer et al. |
| 4,062,641 | A | 12/1977 | Hovmand |
| 4,070,766 | A | 1/1978 | Kamphuis |
| 4,072,570 | A | 2/1978 | Williams |
| 4,099,982 | A | 7/1978 | Hansen |
| 4,141,783 | A | 2/1979 | Pisecky |
| 4,198,308 | A | 4/1980 | Micciche |
| 4,261,793 | A | 4/1981 | Nakamura et al. |
| 4,276,312 | A | 6/1981 | Merritt |
| 4,281,024 | A | 7/1981 | Hauberg |
| 4,302,481 | A | 11/1981 | Ribnitz et al. |
| 4,362,273 | A | 12/1982 | Seino et al. |
| 4,420,442 | A | 12/1983 | Sands |
| 4,422,900 | A | 12/1983 | Bordelon et al. |
| 4,438,147 | A | 3/1984 | Hedrick, Jr. |
| 4,476,042 | A | 10/1984 | Sprecker |
| 4,476,147 | A | 10/1984 | Hall |
| 4,481,221 | A | 11/1984 | Mookherjee |
| 4,481,224 | A | 11/1984 | Muralidhara |
| 4,490,403 | A | 12/1984 | Pisecky |
| 4,511,592 | A | 4/1985 | Percel et al. |
| 4,515,987 | A | 5/1985 | Boden |
| 4,520,032 | A | 5/1985 | Hall |
| 4,521,613 | A | 6/1985 | Pittet |
| 4,521,634 | A | 6/1985 | Fujioka |
| 4,522,765 | A | 6/1985 | Wiegers |
| 4,524,010 | A | 6/1985 | Reuter et al. |
| 4,525,364 | A | 6/1985 | Wiegers |
| 4,532,145 | A | 7/1985 | Saleeb et al. |
| 4,532,364 | A | 7/1985 | Fujioka |
| 4,535,192 | A | 8/1985 | Hall |
| 4,537,704 | A | 8/1985 | Sprecker |
| 4,539,143 | A | 9/1985 | Boden |
| 4,539,209 | A | 9/1985 | Wilson |
| 4,544,775 | A | 10/1985 | Fujioka |
| 4,548,821 | A | 10/1985 | Hall |
| 4,552,770 | A | 11/1985 | Pittet |
| 4,565,707 | A | 1/1986 | Pittet |
| 4,568,538 | A | 2/1986 | Boden |
| 4,571,344 | A | 2/1986 | Pittet |
| 4,600,576 | A | 7/1986 | Pittet |
| 4,613,511 | A | 9/1986 | Pittet |
| 4,614,831 | A | 9/1986 | Sprecker |
| 4,619,780 | A | 10/1986 | Fujioka |
| 4,620,945 | A | 11/1986 | Mookherjee |
| 4,623,538 | A | 11/1986 | Pittet |
| 4,623,547 | A | 11/1986 | Pittet |
| 4,626,440 | A | 12/1986 | Pittet |
| 4,629,586 | A | 12/1986 | Wilson |
| 4,629,805 | A | 12/1986 | Sprecker |
| 4,632,831 | A | 12/1986 | Hall |
| 4,643,903 | A | 2/1987 | Sprecker |
| 4,661,281 | A | 4/1987 | Seiter et al. |
| 4,677,207 | A | 6/1987 | Boden |
| 4,679,733 | A | 7/1987 | Lipp |
| 4,680,142 | A | 7/1987 | Pittet |
| 4,681,976 | A | 7/1987 | Sprecker |
| 4,724,121 | A | 2/1988 | Weyand |
| 4,762,636 | A | 8/1988 | Balliello et al. |
| 4,794,193 | A | 12/1988 | Pittet |
| 4,804,496 | A | 2/1989 | Lowery et al. |
| 4,840,801 | A | 6/1989 | Mookherjee |
| 4,849,125 | A | 7/1989 | Seiter et al. |
| 4,865,853 | A | 9/1989 | Mookherjee |
| 4,873,112 | A | 10/1989 | Mitchell et al. |
| 4,883,884 | A | 11/1989 | Boden |
| 4,892,910 | A | 1/1990 | Klesse et al. |
| 4,931,203 | A | 6/1990 | Ahmed et al. |
| 4,936,901 | A | 6/1990 | Surgant et al. |
| 4,950,495 | A | 8/1990 | Boden |
| 4,962,089 | A | 10/1990 | Boden |
| 4,983,579 | A | 1/1991 | Boden |
| 5,004,618 | A | 4/1991 | Buckholz, Jr. |
| 5,094,860 | A | 3/1992 | Newhall |
| 5,100,509 | A | 3/1992 | Pisecky |
| 5,124,162 | A | 6/1992 | Boskovic et al. |
| 5,130,149 | A | 7/1992 | Keller |
| 5,137,741 | A | 8/1992 | Zampino |
| 5,153,011 | A | 10/1992 | Patel et al. |
| 5,196,219 | A | 3/1993 | Hsu et al. |
| 5,227,017 | A * | 7/1993 | Tanaka et al. ..... 159/4.01 |
| 5,338,553 | A | 8/1994 | Johnson |
| 5,354,742 | A | 10/1994 | Deming et al. |
| 5,391,647 | A | 2/1995 | Yamamoto et al. |
| 5,443,829 | A | 8/1995 | Kensil et al. |
| 5,445,839 | A | 8/1995 | Hagiwara et al. |
| 5,462,978 | A | 10/1995 | Penzel et al. |
| 5,506,353 | A | 4/1996 | Subramaniam |
| 5,525,367 | A | 6/1996 | King |
| 5,593,715 | A | 1/1997 | Christensen |
| 5,702,749 | A | 12/1997 | Sugiura et al. |
| 5,759,599 | A | 6/1998 | Wampler |
| 5,773,061 | A | 6/1998 | Getler |
| 5,786,017 | A | 7/1998 | Blake |
| 5,840,360 | A | 11/1998 | Larsen |
| 5,891,473 | A | 4/1999 | Stanier |
| 5,968,575 | A | 10/1999 | Rasmussen |
| 6,048,565 | A | 4/2000 | Getler |
| 6,058,624 | A | 5/2000 | Bach et al. |
| 6,077,543 | A | 6/2000 | Gordon et al. |
| 6,200,949 | B1 | 3/2001 | Reijmer et al. |
| 6,251,463 | B1 | 6/2001 | Rossy |
| 6,253,463 | B1 | 7/2001 | Hansen |
| 6,325,859 | B1 | 12/2001 | De Roos |
| 6,335,045 | B1 | 1/2002 | Peters |
| 6,387,431 | B1 | 5/2002 | Gautschi |
| 6,391,361 | B1 | 5/2002 | Peters |
| RE37,860 | E | 9/2002 | Blake |
| 6,474,573 | B1 | 11/2002 | Kelly |
| 6,482,433 | B1 | 11/2002 | DeRoos et al. |
| 6,497,911 | B1 | 12/2002 | Hansen |
| 6,560,897 | B2 | 5/2003 | Chickering et al. |
| 6,582,728 | B1 | 6/2003 | Platz et al. |
| 6,607,771 | B2 | 8/2003 | Benczedi |
| 6,607,778 | B2 | 8/2003 | Mutka |
| 6,649,267 | B2 | 11/2003 | Agawa et al. |
| 6,652,898 | B2 | 11/2003 | Jensen |
| 6,656,394 | B2 | 12/2003 | Kelly |
| 6,689,755 | B1 | 2/2004 | Gabel et al. |
| 6,723,359 | B2 | 4/2004 | Subramaniam |
| 6,734,158 | B2 | 5/2004 | Starkenmann |
| 6,763,607 | B2 | 7/2004 | Beyerinck et al. |
| 6,769,200 | B2 | 8/2004 | Raehse et al. |
| 6,838,100 | B2 | 1/2005 | Jaeger |
| 6,902,751 | B1 | 6/2005 | Schleifenbaum |
| 6,929,814 | B2 | 8/2005 | Bouwmeesters |
| 6,933,265 | B2 | 8/2005 | Marty |
| 6,962,006 | B2 | 11/2005 | Chickering, III et al. |
| 6,964,385 | B2 | 11/2005 | Kelly |
| 7,022,665 | B2 | 4/2006 | Decorzant |
| 7,090,832 | B2 | 8/2006 | Zanone |
| 7,097,872 | B2 | 8/2006 | Dewis |
| 7,128,936 | B1 | 10/2006 | Hansen |
| 7,176,176 | B2 | 2/2007 | Pickenhagen |
| 7,176,177 | B2 | 2/2007 | Lambrecht |
| 7,204,998 | B2 | 4/2007 | Holzner |
| 7,252,848 | B2 | 8/2007 | Gelin |
| 7,316,826 | B2 | 1/2008 | Kindel |
| 7,332,468 | B2 | 2/2008 | Widder |
| 7,348,035 | B2 | 3/2008 | Schleifenbaum |
| 7,361,376 | B2 | 4/2008 | Dewis |
| 7,378,121 | B2 | 5/2008 | Ley |
| 7,534,460 | B2 | 5/2009 | Dewis |
| 7,651,713 | B2 | 1/2010 | Keller |
| 2002/0187221 | A1 | 12/2002 | Tanaka et al. |
| 2003/0003212 | A1 | 1/2003 | Chien |

(56) References Cited

U.S. PATENT DOCUMENTS

| | | | |
|---|---|---|---|
| 2003/0021883 | A1 | 1/2003 | Skiff |
| 2003/0082272 | A1 | 5/2003 | Bouwmeesters |
| 2003/0192815 | A1 | 10/2003 | Kelly |
| 2003/0196957 | A1 | 10/2003 | Henningfield |
| 2003/0205629 | A1 | 11/2003 | Kelly |
| 2004/0062845 | A1 | 4/2004 | Krawczyk et al. |
| 2004/0253343 | A1 | 12/2004 | Ha et al. |
| 2005/0031769 | A1 | 2/2005 | Watanabe et al. |
| 2005/0209443 | A1 | 9/2005 | Bolen |
| 2005/0282728 | A1 | 12/2005 | Narula |
| 2006/0035008 | A1 | 2/2006 | Virgallito |
| 2006/0159818 | A1 | 7/2006 | Kunieda |
| 2006/0264130 | A1 | 11/2006 | Karles |
| 2007/0054837 | A1 | 3/2007 | Weiss |
| 2007/0078071 | A1 | 4/2007 | Lee et al. |
| 2007/0117727 | A1 | 5/2007 | Narula |
| 2007/0166185 | A1 | 7/2007 | Bartels |
| 2007/0184163 | A1 | 8/2007 | Toth |
| 2007/0218179 | A1 | 9/2007 | Ott |
| 2007/0231424 | A1 | 10/2007 | Castro et al. |
| 2007/0297993 | A1 | 12/2007 | Kindel |
| 2008/0008801 | A1 | 1/2008 | Barnekow |
| 2008/0015264 | A1 | 1/2008 | Schleifenbaum |
| 2008/0057175 | A1 | 3/2008 | Barnekow |
| 2008/0063747 | A1 | 3/2008 | Boghani et al. |
| 2008/0064625 | A1 | 3/2008 | Holscher |
| 2008/0081779 | A1 | 4/2008 | Holscher |
| 2008/0107786 | A1 | 5/2008 | Barnekow |
| 2008/0113073 | A1 | 5/2008 | Ley |
| 2008/0199592 | A1 | 8/2008 | Fexer |
| 2008/0214675 | A1 | 9/2008 | Ley |
| 2008/0220140 | A1 | 9/2008 | Ley |
| 2008/0227866 | A1 | 9/2008 | Ley |
| 2008/0241322 | A1 | 10/2008 | Bunge |
| 2008/0242585 | A1 | 10/2008 | Ott |
| 2008/0242740 | A1 | 10/2008 | Ley |
| 2008/0292763 | A1 | 11/2008 | Looft |
| 2008/0305052 | A1 | 12/2008 | Ley |
| 2008/0317923 | A1 | 12/2008 | Ley |
| 2009/0081140 | A1 | 3/2009 | Brocke |
| 2009/0091049 | A1 | 4/2009 | Nielsen |
| 2009/0092725 | A1 | 4/2009 | Panten |
| 2009/0110796 | A1 | 4/2009 | Backes |
| 2009/0124701 | A1 | 5/2009 | Langer |
| 2009/0155445 | A1 | 6/2009 | Le |
| 2009/0155446 | A1 | 6/2009 | Reiss |
| 2009/0163403 | A1 | 6/2009 | Levorse |
| 2009/0163404 | A1 | 6/2009 | Levorse |
| 2009/0252789 | A1 | 10/2009 | Tropharddy |
| 2009/0291176 | A1 | 11/2009 | Nagao et al. |
| 2010/0055267 | A1 | 3/2010 | Popplewell et al. |
| 2010/0196493 | A1 | 8/2010 | Buisson |
| 2011/0059205 | A1 | 3/2011 | Gaysinsky et al. |
| 2011/0064783 | A1 | 3/2011 | Bang-Madsen et al. |
| 2013/0022728 | A1 | 1/2013 | Popplewell et al. |
| 2014/0193562 | A1 | 7/2014 | Popplewell et al. |
| 2014/0205713 | A1 | 7/2014 | Hans et al. |

FOREIGN PATENT DOCUMENTS

| | | | |
|---|---|---|---|
| CA | 1334460 | C | 3/1989 |
| CA | 1314432 | C | 3/1993 |
| CA | 2171389 | C | 3/1996 |
| CA | 2258751 | C | 12/1997 |
| CA | 2253154 | C | 5/1999 |
| CA | 2321660 | C | 9/1999 |
| CA | 2407614 | C | 11/2001 |
| CA | 2663386 | A1 | 4/2008 |
| EP | 0322137 | A1 | 6/1989 |
| EP | 0344375 | B1 | 12/1989 |
| EP | 0232313 | B1 | 5/1990 |
| EP | 0180366 | B1 | 6/1990 |
| EP | 0420509 | A1 | 4/1991 |
| EP | 0227486 | B1 | 11/1991 |
| EP | 0515478 | B1 | 12/1993 |
| EP | 0429482 | B1 | 4/1994 |
| EP | 0461197 | B1 | 6/1994 |
| EP | 0517423 | B1 | 3/1995 |
| EP | 0366898 | B1 | 2/1996 |
| EP | 0619075 | B1 | 1/1997 |
| EP | 0832695 | A2 | 4/1998 |
| EP | 1064856 | A2 | 1/2001 |
| EP | 1106081 | A1 | 6/2001 |
| EP | 1280591 | B1 | 12/2006 |
| EP | 1435797 | B1 | 8/2007 |
| EP | 2052622 | A1 | 4/2009 |
| EP | 2138567 | A1 | 12/2009 |
| GB | 575118 | A | 2/1946 |
| GB | 1015599 | A | 1/1966 |
| GB | 2364714 | A | 2/2002 |
| IE | 62024 | B1 | 12/1994 |
| WO | 9117821 | A1 | 11/1991 |
| WO | 9428181 | A2 | 12/1994 |
| WO | 9513864 | A1 | 5/1995 |
| WO | 9517174 | A1 | 6/1995 |
| WO | 9713416 | A1 | 4/1997 |
| WO | 9714288 | A2 | 4/1997 |
| WO | 9733485 | A1 | 9/1997 |
| WO | 9804243 | A1 | 2/1998 |
| WO | 0167897 | A1 | 9/2001 |
| WO | 0207541 | A1 | 1/2002 |
| WO | 2005063032 | A1 | 7/2005 |
| WO | 2006082536 | A1 | 8/2006 |
| WO | 2007054853 | A1 | 5/2007 |
| WO | 2007096790 | A1 | 8/2007 |
| WO | 2007135583 | A2 | 11/2007 |
| WO | 2008047301 | A1 | 4/2008 |
| WO | 2008077399 | A1 | 7/2008 |
| WO | 2008113778 | A1 | 9/2008 |
| WO | 2010104713 | A1 | 9/2010 |
| WO | 2011121468 | A1 | 10/2011 |
| WO | 2012122010 | A2 | 9/2012 |

OTHER PUBLICATIONS

H. Leuenberger, Spray freeze-drying—the process of choice for low water soluable drugs?, Journal of Nonpartical Research 4: pp. 111-119 (2002).

Mukesh C. Gohel, Spray Drying: A Review, Pharmaceutical Reviews, vol. 7 Issue 5, pp. 1-20 (Sep. 2009) http://www.pharmainfo.net/reviews/spray-drying-review.

J. Broadhead, S. K. Edmond Rouan and C. T. Rhodes, The Spray Drying of Pharmaceuticals, Drug Development and Industrial Pharmacy, vol. 18, Issue 11&12, pp. 1169-1206 (1992).

A. M. Goula and K. G. Adamopolous, Spray drying of tomato pulp: Effect of feed concentration, Drying Technology, vol. 22, pp. 2309-2330 (2004).

A. G. Bailey, Electrostatic Spraying of Liquids, John Wiley & Sons Inc., New York, pp. 1-35 (Apr. 1988).

Lord Rayleigh, On the equilibrium of liquid conducting masses charged with electricity, Philos. Mag. vol. 14, pp. 184-186 (1882).

A. Gomez and K. Tang, Charge and fission of drops in electrostatic sprays, Phys. Fluids vol. 6, Issue 1, pp. 404-414 (Jan. 1994).

W. A. Sirignano, Fluid Dynamics and Transport of Droplets and Sprays, 2nd edition, Cambridge University Press New York, cover and p. 34 (2010).

GEA Processing Engineering Inc., Powder Technology Division; Spray Drying, pp. 1-15, http://www.niroinc.com/ (date unknown).

Vagn Westergaard, Dainsh Dairy & Food Industry . . . Worldwide; The New Niro Intergrated Filter Dryer IFD™, cover page and pp. 62-64 (Sep. 2002).

D. E. Dobry, D. M. Settell, J. M. Baumann, R. J. Ray, L. J. Graham and R. A. Beyerinck, A Model-Based Methodology for Spray-Drying Process Development, J. Pharm. Innov. vol. 4, pp. 133-142 (Jul. 2009).

M. J. Killen, Process for Spray Drying and Spray Congealing, Pharm. Eng. vol. 13, pp. 56-62 (Jul./Aug. 1993).

(56) References Cited

OTHER PUBLICATIONS

Mumenthaler and H. Leuenberger, Atmospheric Spray-Freeze Drying: Suitable Alternative in Freeze Dry Technology, Int. J. Pharm. vol. 72, pp. 97-110, (Jan. 1991).

T.A.G. Langrish and D.F. Fletcher, Spray Drying of Food Ingredients and Applications of CFD in Spray Drying, Chem. Engineering and Proc., vol. 40, pp. 345-354 (2001).

W.J. Coumans, P.J.A.M. Kerkhof and S. Brvin, Theotrical and Practical Aspects of Aroma Retention in Spray Drying and Freeze Drying, Drying Technology, vol. 12, pp. 99-149 (1994).

* cited by examiner

100

METHODS AND APPARATUS FOR LOW HEAT SPRAY DRYING

CROSS REFERENCE TO RELATED APPLICATIONS

This application claims the benefit of U.S. Provisional Patent Application No. 61/386,762, filed Sep. 27, 2010, the entire disclosure of which is hereby incorporated by reference.

BACKGROUND

The present invention relates to methods and apparatus for spray drying a liquid product into a dried powder without applying heat, or applying substantially low amounts of heat.

Spray drying is a method of producing a dry powder from a liquid or slurry by rapidly drying with a hot gas (usually air). Spray drying technology has existed since the late 1800's and has continually evolved over the past century.

The spray drying process begins with a liquid solvent, commonly water, containing dissolved or suspended components such as an emulsion. The suspension includes a substance to be encapsulated (the load) and an amphipathic carrier (usually some sort of modified starch), which are homogenized as a suspension in the liquid solvent. The load is typically some constituent component(s) of a food, fragrance, medicament, etc., and the homogenized suspension is often referred to as a slurry.

Spray dryers use some type of atomizer, such as a spray nozzle, to disperse the slurry into a controlled spray having some relatively controlled droplet size. Depending on the process requirements, droplet sizes may range from about 10 to 500 microns in diameter. The most common applications require droplet sizes in the 50 to 200 micron range.

In conjunction with atomization, the slurry is fed into a drying chamber, usually a tower into which heated air is also introduced. The temperature of the air as it enters the drying chamber is well over the boiling point of water, usually in the range of 180-200° C. The heated air supplies energy for evaporation of volatile components of the liquid (the water) from the droplets. As the water evaporates, the carrier forms a hardened shell around the load, producing a dried powder.

Reference is made to FIG. 1, which illustrates a conventional spray drying system 50 and associated process. The process begins with making a slurry of ingredients. The ingredients include a liquid solvent, such as water 1, a carrier 2, and active ingredient(s) 3. In the typical process, the water 1 and carrier 2 are added into the solution tank 4 while stirring. The active ingredient 3 is then added to the tank 4 and stirred into the slurry. The active ingredient is either emulsified in the carrier fluid system or dissolved into it. In order for conventional spray drying processes to be commercially viable, typical slurry viscosities must be in the range of about 10-300 mPa-s.

The slurry formed in the solution tank 4 is delivered to an atomizer 6 using a feed pump 5 or other means of conveyance. The slurry enters the atomizer 6 and leaves the atomizer as a spray of liquid droplets 8, and the droplets 8 are introduced into a drying chamber 7. Concurrently, a feed of air is heated by a process heater 11 and supplied into the drying chamber 7 by a blower 10. The water evaporated from the droplets 8 enters the heated air as the atomized liquid droplets 8 dry to form solid particles after exposure to the incoming heated air.

The dried powder leaves the dryer chamber 7 along with the water vapor laden air, and is carried to a cyclone separator 12, which removes the dried particles from the circulating air stream and deposits the particles into a collection container 13. The water vapor laden air exits the collection container 13 and enters a baghouse 14, where very fine particles are removed before the water vapor laden air is sent into a condenser 9, via blower 15. The condenser 9 removes the water vapor from the process air, and the collected water may be re-used or discarded.

One of the prominent attributes of the traditional spray drying process is the high temperature of the inlet gas (typically on the order of 200° C.) leaving the heater 11 and entering the drying chamber 7, as well as the temperature of the outlet gas exiting the drying chamber 7, which is usually in excess of 100° C. Although the liquid droplets 8 are injected into the high temperature environment within the chamber 7, the droplets 8 do not actually reach the inlet gas temperature. The droplets 8, however, do become heated to a point at which considerable portions of desired constituents of the droplets (i.e., portions of the load) are undesirably modified, such as evaporated and/or oxidized. The undesirable modification to the load (load loss) leads to a reduction in flavor (in the case of food loads), a reduction in aroma (in the case of fragrances), etc. Essentially, evaporation and heat degradation of the load lowers the performance characteristics of the final powder product, and therefore results in a significant degradation of performance in commercial use and a significant loss of revenue.

The above disadvantageous characteristics of the conventional spray dry process have resulted in many process modifications and emulsion formulations to compensate for heat induced alterations in the load. This is especially true in the pharmaceutical industry, where excessive heating during spray drying leads to degradation of the active ingredient in a powdered medicament. This also presents a challenge to flavorists in the powdered flavor industry to design flavor formulations that can survive the drying process and deliver acceptable (although significantly flawed) flavor characteristics.

In view of the above, there are needs in the art for new methods and apparatus for carrying out the spray drying process, which reduce or eliminate the disadvantageous characteristics of the conventional spray dry process.

SUMMARY OF THE INVENTION

Methods and apparatus for spray drying a liquid product into a dried powder without applying heat provide for: forming a slurry including a liquid solvent, a carrier, and an active ingredient; applying an electrostatic charge to the slurry; atomizing the charged slurry to produce a plurality of electrostatically charged, wet particles; suspending the electrostatically charged, wet particles for a sufficient time to permit repulsive forces induced by the electrostatic charge on at least some wet particles to cause at least some of such particles to divide into wet sub-particles; and continuing the suspending step, without the presence of any heated drying fluids, for a sufficient time to drive off a sufficient amount of the liquid solvent within most of the wet particles to leave a plurality of dried particles (the powder), each dried particle containing the active ingredient encapsulated within the carrier.

Preferably, a temperature of the non-heated drying fluid is less than about 100° C. at introduction into the drying chamber, such as at least one of: less than about 75° C. at introduction into the drying chamber; less than about 45° C. at introduction into the drying chamber; less than about 35° C. at introduction into the drying chamber; less than about 30° C.

at introduction into the drying chamber; and at about an ambient temperature of a room within which the drying chamber is located.

The methods and apparatus may further provide for subjecting the electrostatically charged, wet particles to a non-heated drying fluid within a drying chamber to drive off the liquid solvent. Alternatively or additionally, the methods and apparatus may further provide for dehumidifying the non-heated drying fluid prior to introduction into the drying chamber. Alternatively or additionally, the methods and apparatus may further provide for applying one or more electric fields within the drying chamber to urge at least one of the wet particles and the dry particles to travel in a direction defined from an inlet end of the drying chamber to an outlet end of the drying chamber.

The methods and apparatus may further provide for controlling one or more of a viscosity of the slurry during formation a ratio of water within the slurry during formation, such that one or more of: (i) the viscosity of the slurry at the atomization step is at least one of: greater than about 300 mPa-s; greater than about 350 mPa-s; greater than about 400 mPa-s; greater than about 500 mPa-s; greater than about 600 mPa-s; greater than about 700 mPa-s; between about 500-16,000 mPa-s; and between about 1000-4000 mPa-s; and (ii) the ratio of water within the slurry at the atomization step is at least one of: between about 20-50 weight percentage; between about 20-45 weight percentage; between about 20-45 weight percentage; between about 20-40 weight percentage; about 30 weight percentage.

The apparatus may include a drying chamber, including an inlet end, an outlet end, and an internal volume within which the liquid product is dried, where the drying chamber is formed from a non-electrically conductive material.

Additionally or alternatively, a first electrode may be located at or near the inlet end of the drying chamber; and a second electrode may be located at or near the outlet end of the drying chamber, where application of a source of voltage potential between the first and second electrodes induces an electric field within the drying chamber sufficient to urge particles of the liquid product, produced by way of atomization, from the inlet end toward the outlet end of the drying chamber. Preferably, the first and second electrodes are disposed external to the drying chamber, yet induce an electric field within the internal volume of the drying chamber by virtue of the formation of the drying chamber from the non-electrically conductive material.

The apparatus may additionally or alternatively include a nozzle operating to atomize a slurry to produce a plurality of wet particles, where the slurry includes a liquid solvent, a carrier, and an active ingredient. The apparatus may further include at least one electrode operating to contact the slurry and apply an electrostatic charge thereto, such that the nozzle operates to produce a plurality of electrostatically charged wet particles. The at least one electrode may be disposed within the nozzle such that the slurry contacts the electrode and becomes electrostatically charged while flowing from an inlet end to an outlet end of the nozzle.

A dried powder produced using one or more aspects of the invention may include: a plurality of dried particles, which individually contain an amount of final active ingredient encapsulated within a carrier resulting from drying a slurry containing an initial active ingredient, a liquid solvent and the carrier, wherein: the initial active ingredient includes one or more constituent components, at least one of which is among one or more principle molecular types from which at least one of a desirable food, flavor, fragrance, medicament, and pigment is obtained; the final active ingredient includes one or more of the constituent components corresponding with those of the initial active ingredient as modified by the drying of the slurry; and wherein a weight percentage of at least one of the one or more principle molecular types in the final active ingredient is within about 5% of a weight percentage of the corresponding principle molecular types in the initial active ingredient.

Alternatively or additionally, the weight percentage of at least one of the one or more principle molecular types in the final active ingredient may be within about 3%, 2% or 1% of a weight percentage of the corresponding principle molecular types in the initial active ingredient.

Additionally or alternatively, a dried powder produced using one or more aspects of the invention may include: a plurality of dried particles, which individually contain an amount of active ingredient encapsulated within a carrier, wherein: the active ingredient includes one or more constituent components, at least one of which is among one or more principle molecular types from which at least one of a desirable food, flavor, fragrance, medicament, and pigment is obtained; and wherein a weight percentage of at least one of the one or more principle molecular types in the active ingredient does not vary by more than about 5% during aging of the dried powder during any period of elevated temperature of about 95° F. up to about 1000 hours.

Additionally or alternatively, the weight percentage of at least one of the one or more principle molecular types in the active ingredient does not vary by more than about 3%, 2% or 1% during aging of the dried during any period of elevated temperature of about 95° F. up to about 1000 hours.

Other aspects, features, and advantages of the present invention will be apparent to one skilled in the art from the description herein taken in conjunction with the accompanying drawings.

DESCRIPTION OF THE DRAWINGS

For the purposes of illustration, there are forms shown in the drawings that are presently preferred, it being understood, however, that the invention is not limited to the precise arrangements and instrumentalities shown.

DETAILED DESCRIPTION OF THE PREFERRED EMBODIMENTS

Figure 1:
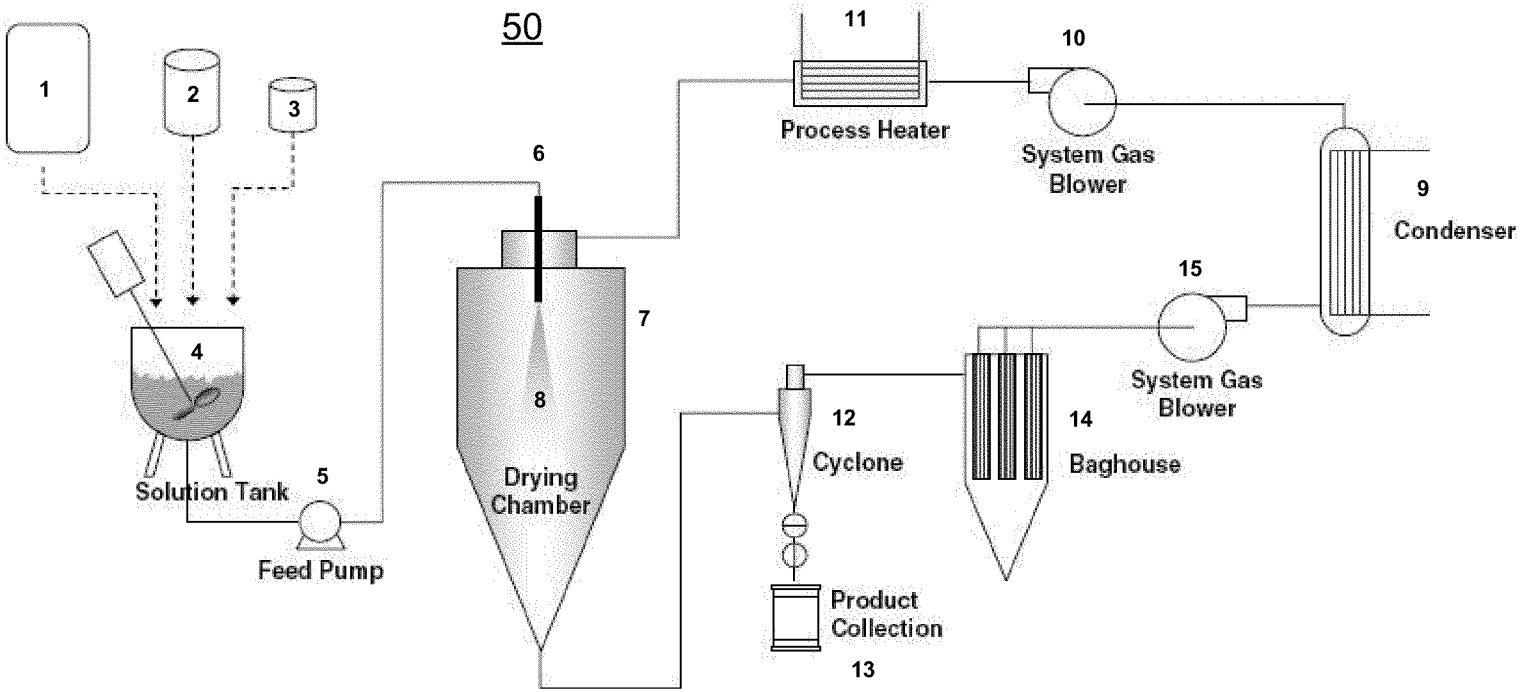
FIG. 1 (Prior Art)
FIG. 1 is a system for spray drying a liquid product into a dried powder through the convention application of heated air in accordance with the prior art.
Figure 2:
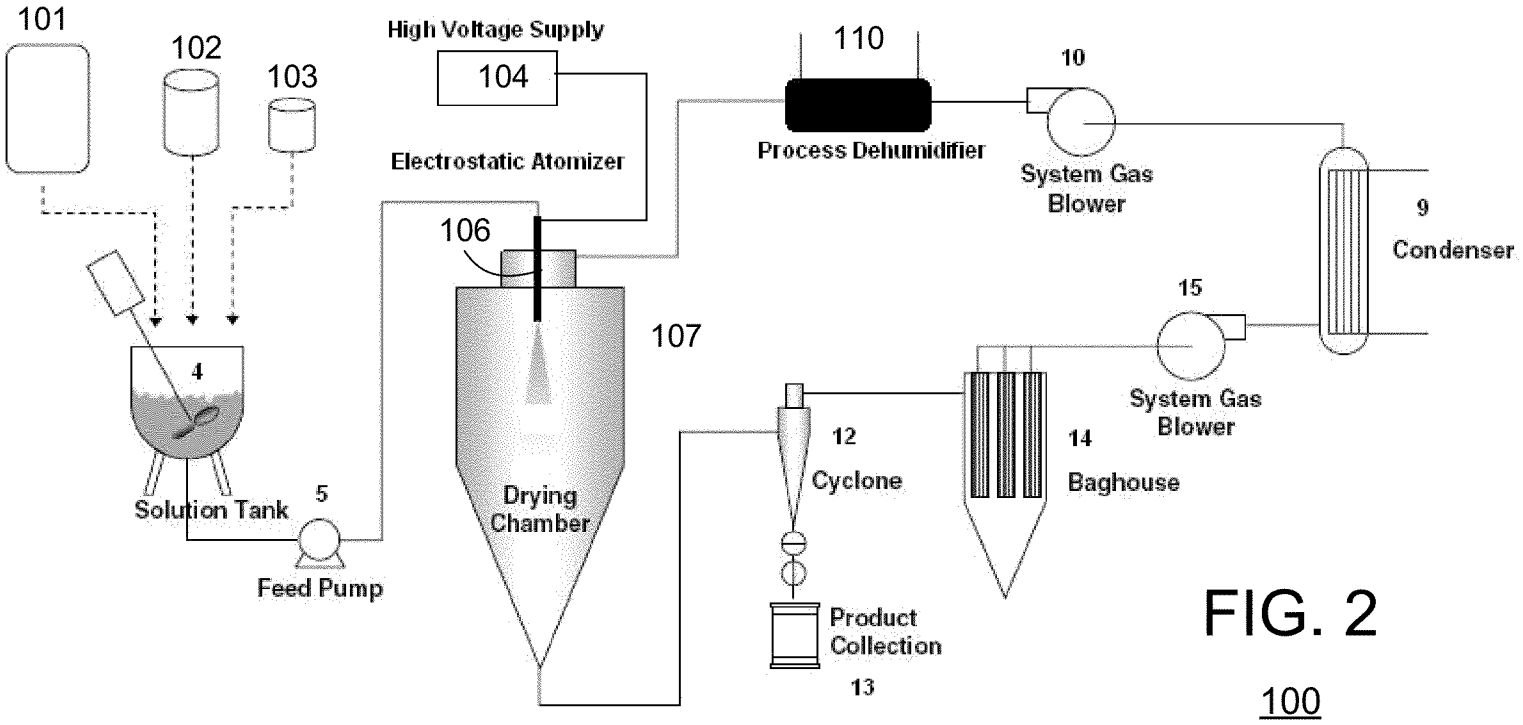
FIG. 2 is a system for spray drying a liquid product into a dried powder without employing heated air in accordance with one or more aspects of the present invention.

With reference to the drawings, wherein like numerals indicate like elements, there is shown in FIG. 2 a system 100 for spray drying a liquid product into a dried powder without employing heated air in accordance with one or more aspects of the present invention. The system 100 includes some of the same or similar elements as in the system 50 of FIG. 1, which elements have the same reference designators.

By way of a high level description, the system 100 includes a drying chamber 107 into which a slurry is fed by way of a feed pump 5 (or equivalent conveying mechanism). The slurry enters an atomizer 106 and leaves the atomizer as a spray of liquid droplets 108, which are introduced into the drying chamber 7. Concurrently, a feed of non-heated fluid (such as air or another suitable gas) is supplied into the drying chamber 107 by a blower 10. The supplied air may be subjected to dehumidification (via dehumidifier 110) prior to introduction into the drying chamber 107. The atomized liquid droplets 108 dry to form solid particles after exposure to the incoming air. Water evaporates from the droplets 108 and enters the air within the drying chamber 107. Dried powder leaves the drying chamber 107 along with the water vapor laden air, and is carried to a cyclone separator 12, which removes the dried particles from the circulating air stream and deposits the particles into a collection container 13. The water vapor laden air exits the collection container 13 and enters a baghouse 14, where very fine particles are removed before the water vapor laden air is sent into a condenser 9, via blower 15. The condenser 9 removes the water vapor from the process air, and the collected water may be re-used or discarded.

There are a number of very significant differences between the systems of FIGS. 1 and 2. Among these differences is the fact that the system 100 and related spray drying process does not use a heated fluid (e.g., air) to dry the atomized droplets within the drying chamber. The use of non-heated air is directly counter to the conventional and accepted wisdom in the spray drying art. Indeed, there is no known prior art spray drying process or system that does not use significantly heated air (on the order of 200° C.) in the drying process, despite the fact that the load loss associated with the heating process is well understood by skilled artisans. The reason that conventional spray drying processes call for heated air, however, is that artisans have failed to develop an alternative to using heated air that results in suitable (albeit degraded) dried powder product.

Among the reasons that non-heated air may be used in the spray drying system 100 and process is that the slurry is not conventional. In general, the slurry includes a liquid solvent, a carrier, and an active ingredient. The liquid solvent is usually water, however, other suitable solvents may be employed if needed or desired. The carrier is usually a modified starch. The active ingredient may be any desirable single constituent component or a combination of constituent components, at least one of which is among one or more principle molecular types from which at least one of a desirable food, flavor, fragrance, medicament, pigment, probiotic, bacteria, etc. is obtained.

Formation of the slurry is controlled such that regulation of at least one of the viscosity, the amount of liquid solvent (e.g., water), or other suitable metric relating to the water content of the slurry, is obtained. For example, the formation of the slurry may include controlling a viscosity of the slurry such that the viscosity at the atomization step is at least one of: greater than about 300 mPa-s; greater than about 350 mPa-s; greater than about 400 mPa-s; greater than about 500 mPa-s; greater than about 600 mPa-s; greater than about 700 mPa-s; between about 500-16,000 mPa-s; and between about 1000-4000 mPa-s. Additionally or alternatively, the formation of the slurry may include controlling a ratio of water within the slurry such that the ratio of water within the slurry at the atomization step is at least one of: between about 20-50 weight percentage; between about 20-45 weight percentage; between about 20-45 weight percentage; between about 20-40 weight percentage; and about 30 weight percentage. In order to provide some information as to the significant differences between a slurry according to one or more embodiments of the invention and conventional slurries, it is noted that conventional slurries have viscosities between about 10-200 mPa-s and contain an amount of water between about 50-70% by weight.

Another reason that non-heated air may be used in the spray drying system 100 (and process) relates to an unconventional electrostatic charging process that is conducted before, during or after atomization. In particular, an electrostatic charge is applied to the slurry or to the atomized droplets 108, preferably the former. In this regard, the system 100 includes a high voltage supply 104 (such as about 45 kV DC) that is coupled to one or more electrodes (not shown in FIG. 2). The polarity of the high voltage supply 104 may be in either the positive or negative configuration. The slurry (or atomized droplets 108) is brought into contact with the electrode to impart an electrical charge thereto. In a preferred embodiment, the slurry is brought into contact with the electrode(s) in order to produce a charged slurry. Concurrently or thereafter, the charged slurry is atomized to produce a plurality of electrostatically charged, wet particles (droplets) 108.

The respective charge on the wet droplets 108 produces a force that tends to cause adjacent droplets to repel one another. Additionally, the force on a given droplet 108 opposes the surface tension of such given droplet 108. When the charge on the given droplet 108 exceeds a threshold level, the Rayleigh limit, the droplet 108 becomes unstable and smaller satellite droplets 108 are ejected from the given (parent) droplet 108. One or more of the satellite droplets 108, in turn, might also become unstable and produce additional satellite droplets 108, since the surface charge density does not diminish in the satellite droplets 108 as evaporation takes place.

The electrostatically charged, wet particles/droplets 108 are suspended for a sufficient time within the drying chamber 107 to permit the aforementioned repulsive forces induced by the electrostatic charge on at least some wet particles/droplets 108 to cause at least some of such particles to divide into wet sub-particles/droplets 108. The suspension of the droplets 108 continues, without the presence of any heated drying fluids, for a sufficient time to drive off a sufficient amount of the liquid solvent within most of the wet particles/droplets 108 to leave a plurality of dried particles (the powder), each dried particle containing the active ingredient encapsulated within the carrier. Notably, the production of sub-particles/droplets 108 from a given volume of atomized slurry (i.e., from a given droplet 108) results in faster drying of such volume due to a greatly increased aggregate surface area of the sub-particles/droplets 108 and concomitant reduction of particle volume of each sub-particle/droplet 108 following each fission event.

The production of sub-particles/droplets 108 may be referred to as coulombic fission. The time scale for such coulombic fission events is on the order of a few microseconds to milliseconds. The fission of about ten (10) sub-particles/droplets 108 from a given particle/droplet 108 reduces a diameter of the given particle/droplet 108 by about 30%. The amount of time that it takes to achieve such reduction in diameter (on the order of a few microseconds to milliseconds) is an order of magnitude faster than diffusive evaporation in the presence of heated air, which occurs with a characteristic time t in accordance with the following formula:

$$t=do^2/k$$

where do is the diameter of the particle and k is the evaporative diffusion coefficient. For particles in the 20 to 200 mm diameter range, the time to any significant diameter reduction by evaporation is on the order of tenths to several seconds, which is far longer (one to two orders of magnitude) than diameter reduction by coulombic fission.

The individual or combined characteristics of relative low water content in the slurry and electrostatic charge on the droplets 108 permits vastly a different temperature condition within the drying chamber 107 as compared with prior art systems and processes. For example, a temperature of the non-heated drying fluid (air) introduced into the drying chamber 107 may be at least one of: less than about 100° C.; less than about 75° C.; less than about 45° C.; less than about 35° C.; less than about 30° C.; and at about an ambient temperature of a room within which the drying chamber 107 is located. The above temperature ranges assume a lower limit above freezing.

It has been demonstrated that an inlet air temperature of about 40° C. may result in an outlet air temperature of about 32° C. from the drying chamber 107.

While elevated temperatures as compared to the convention spray drying process of the prior art may not be necessary, it may be desirable to ensure that the drying fluid (air) introduced into the drying chamber 107 is of relatively low water content. Thus, the system 100 may include the process dehumidifier 110 in order to remove some amount of water from the air prior to introduction into the drying chamber 107. After dehumidification, the non-heated air as input into the drying chamber 107 may be at a relative humidity of about 7%.

The atomizer 106 may be implemented by way of any of the known methods, apparatus, and/or techniques. For example, the atomizer 106 may be implemented using at least one of: a nozzle technique, a centrifugal technique, a pneumatic technique, and an ultrasonic technique. For most atomization techniques, the slurry does not leave the atomizing mechanism as a final droplet 108, but rather as a fragment of a thin liquid film or ligament. The formation of droplets 108 takes place immediately after the liquid has left the atomizing mechanism, due to the surface tension of the liquid. The droplet size from a given type of atomization depends on the energy input into breaking the slurry into fragments, i.e., increasing the overall effective surface area of the slurry.

The average droplet size and distribution may be fairly constant for a given atomization technique, and may be in the range of 10-300 microns. The electrostatic charge process and resultant coulombic fission process in accordance with the various embodiments herein produces, in general, larger particles than conventional spray drying processes. The larger particles, however, come from even larger, parent particles, which conventional atomizers cannot adequately produce. The daughter particles produced in accordance with the embodiments herein are smaller, and the process tends to make bimodal size distributions for very viscous slurries.

Centrifugal (or rotary) atomization may be considered the most common form of atomization. Centrifugal atomization employs a rotating disc or wheel, which breaks the liquid stream of slurry into droplets. The centrifugal atomization device may employ a disc or wheel of about 5 to 50 cm in diameter, which spins in the range of about 5,000 to 40,000 rpm. The size of the droplets 108 produced by a centrifugal atomization device is about inversely proportional to the peripheral speed of the disc or wheel.

Nozzle atomization employs a pump (e.g., the feed pump of FIG. 2), which pressurizes and forces the slurry through the orifice of a nozzle to break the liquid into fine droplets. The orifice size is usually in the range of 0.5 to 30 mm. The size of the droplets depends on the size of the orifice and the pressure drop. A larger pressure drop across the orifice produces smaller droplets. Therefore, to reduce the particle/droplet size for a given feed rate, a smaller orifice and a higher pump pressure may be employed.

Two-fluid pneumatic atomization employs the interaction of the slurry with another fluid, usually compressed air using a fluid nozzle for the compressed air and a fluid nozzle for the slurry. The pressure of the air and slurry may be in the range of about 200 to 350 kPa. Particle size is controlled by varying a ratio of the compressed air flow to that of the slurry flow.

Sonic atomization employs ultrasonic energy to vibrate a surface at ultrasonic frequencies. The slurry is brought into contact with the vibrating surface in order to produce the particles/droplets 108.

Figure 3:
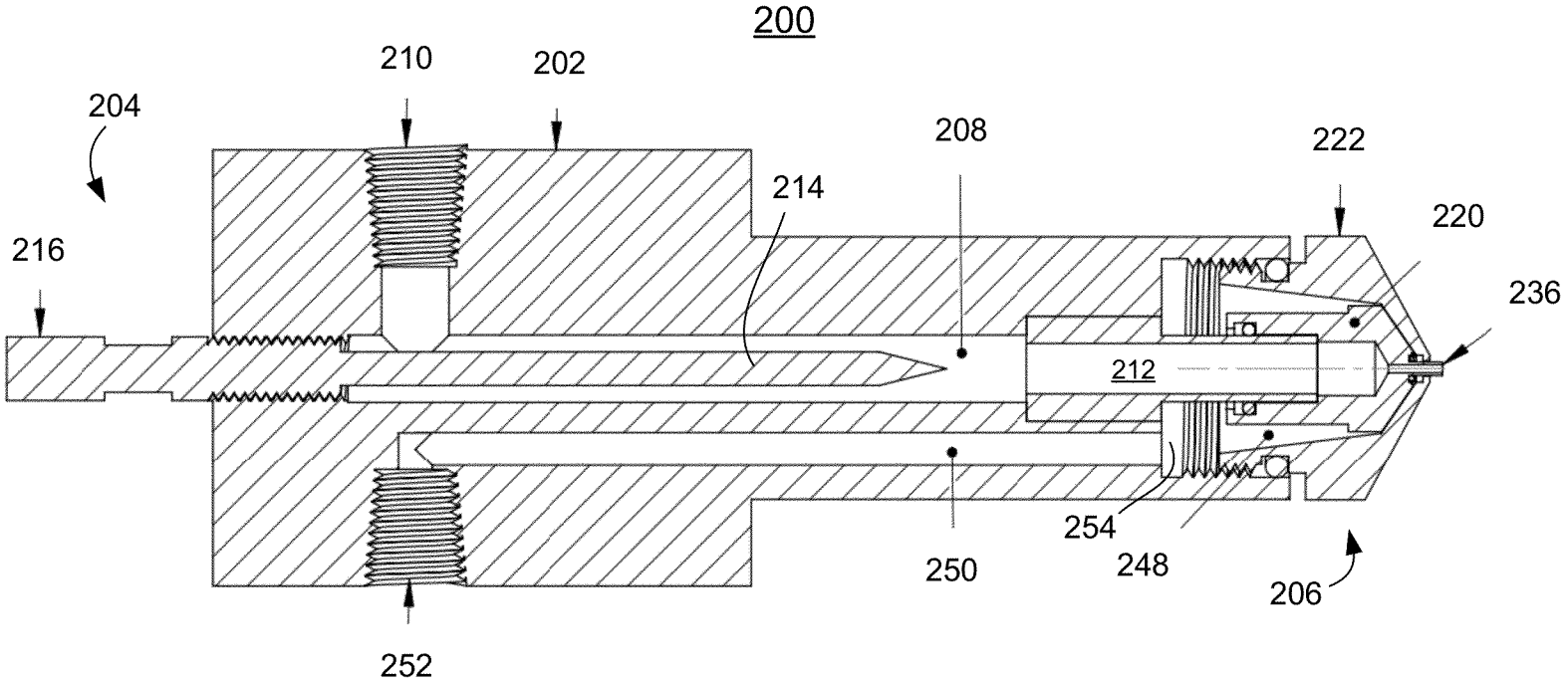
FIG. 3 is a cross-sectional view of an atomizer that may be employed in the system of FIG. 2 in order to produce a plurality of droplets from a slurry in accordance with one or more aspects of the present invention.
Figure 4:
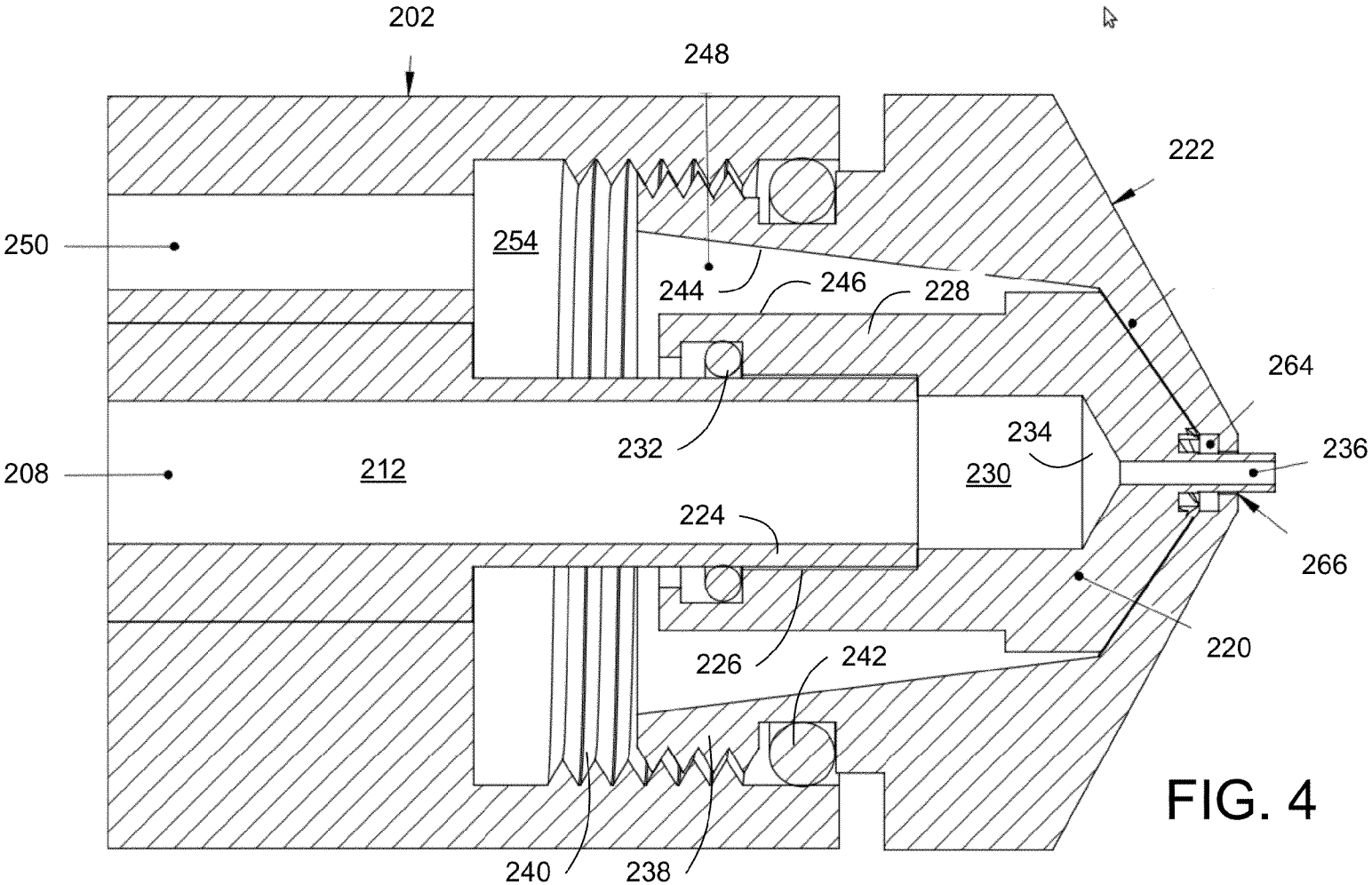
FIG. 4 is a cross-sectional view of a distal end of an atomizer that may be employed in the atomizer of FIG. 3 in accordance with one or more aspects of the present invention.
Figure 5:
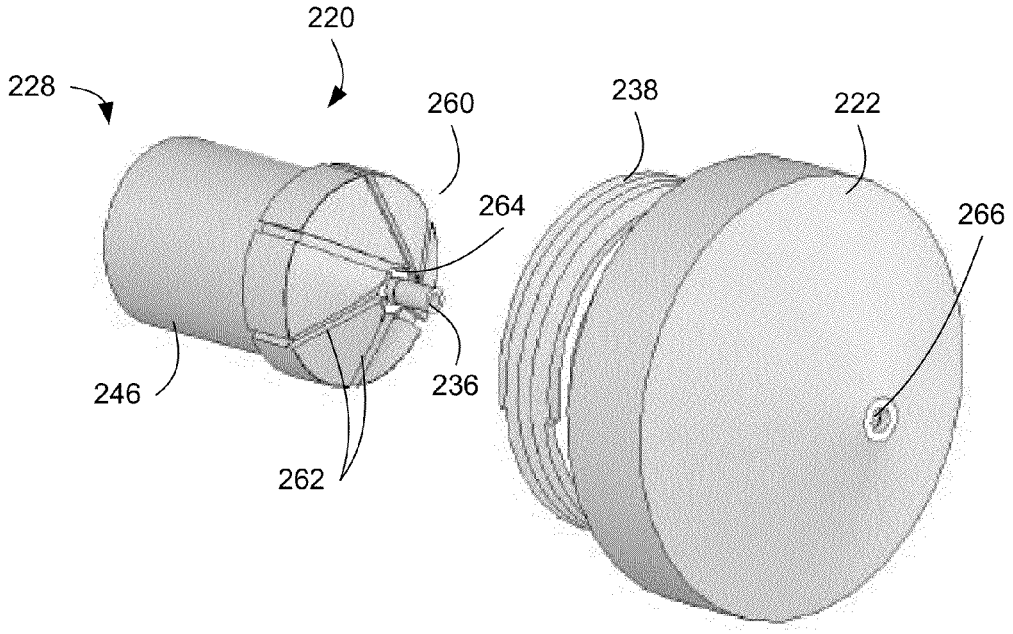
FIG. 5 is a perspective, exploded view of certain components of the distal end of the atomizer of FIG. 4 in accordance with one or more aspects of the present invention.

With reference to FIGS. 3-5, one or more embodiments of the present invention may employ a nozzle-type atomizer 106. FIG. 3 is a cross-sectional view of a two-fluid atomizer 200 that may be employed as the atomizer 106 in the system of FIG. 2 in order to produce the wet particles/droplets 108 from the slurry. FIG. 4 is a cross-sectional view of a distal end of the two-fluid atomizer 200 of FIG. 3, and FIG. 5 is a perspective, exploded view of certain components of the distal end of the two-fluid atomizer 200 of FIG. 4.

The two-fluid atomizer 200 includes a body 202 having a proximal end 204 and a distal end 206. A channel 208 extends through the body 202 and includes an inlet 210, generally near the proximal end 204 of the body 202, and an outlet 212, generally near the distal end 206 of the body 202. The channel 208 operates to convey a first of the two-fluids, i.e., the slurry, from the inlet 210 to the outlet 212.

The two-fluid atomizer 200 also includes at least one electrode 214 operating to contact the slurry and apply an electrostatic charge thereto, such that the two-fluid atomizer 200 operates to produce a plurality of electrostatically charged wet particles/droplets 108. In one or more embodiments, the at least one electrode 214 may be disposed within the body 202 of the two-fluid atomizer 200 such that the slurry contacts the electrode 214 and becomes electrostatically charged while flowing from the inlet 210 to the outlet 212 of the channel 208. As illustrated in FIG. 3, the electrode 214 may be disposed within the channel 208, preferably in a coaxial arrangement, such that a significant portion of the surface area of the electrode 214 is available for contact with the slurry. The electrode 214 may be inserted into the channel 208 by way of a threaded bore of the body 202 and complementary threaded shaft of the electrode 214, which when engaged, positions the electrode within the channel 208. A connection terminal 216 may be electrically and mechanically coupled to the electrode 214 in order to provide a means for connecting with the high voltage supply 104 and receiving voltage potential at the surface of the electrode 214.

With reference to FIGS. 3 and 4, the two-fluid atomizer 200 may include a nozzle 220 in fluid communication with the outlet 212 of the channel 208. In particular, the outlet 212 of the channel 208 includes a tube 224 sized and shaped to engage, and be received within, a complementary bore 226 at an inlet end 228 of the nozzle 220. The engagement of the tube 224 and bore 226 permits fluid communication of the slurry (which has been electrostatically charged) from the channel 208 into an internal volume 230 intermediately disposed within the nozzle 220. A sealing ring 232 may be employed to ensure a fluid tight seal between the tube 224 and the bore 226, even under fluid pressure. The nozzle 220 preferably includes a transition section 234 of reducing diameter (a tapering surface) extending from the internal volume 230 to a nozzle orifice 236. The nozzle orifice 236 is preferably of a generally cylindrical shape, including an internal bore of a size sufficient to produce wet particles/droplets 108 of desired size and shape once they succumb to surface tension forces.

The two-fluid atomizer 200 may further include a nozzle cap 222, which generally surrounds the nozzle 220 and permits the nozzle orifice 236 to extend through a bore 266 at a distal end thereof. The nozzle cap 222 includes an engagement feature at a proximal end thereof, which engages the distal end of the body 202. In particular, the nozzle cap 222 includes a threaded shank 238, which threads into a complementary threaded bore 240 of the body 202. A sealing ring 242 may be employed to ensure a fluid tight seal as between an internal surface 244 of the nozzle cap 222 and an external surface 246 of the nozzle 220, thereby forming an internal volume 248 therebetween.

The two-fluid atomizer 200 includes another channel 250 extending through the body 202, which includes an inlet 252, generally near the proximal end 204 of the body 202, and an outlet 254, generally near the distal end 206 of the body 202. The channel 250 operates to convey a second of the two-fluids, i.e., the non-heated air, from the inlet 252 to the outlet 254. The outlet 254 is in fluid communication with the internal volume 248 (between the internal surface 244 of the nozzle cap 222 and the external surface 246 of the nozzle 220). Thus, the channel 250 operates to convey the non-heated air from the proximal end 204 to the distal end 206 of the two-fluid atomizer 200. The flow of the non-heated air through the two-fluid atomizer 200 may be about 5100 $m^3$/hr at an input pressure of about 130 psi.

As best seen in FIGS. 4-5, the nozzle 220 includes a tapered surface 260 on an exterior thereof, which is downstream of the exterior surface 246 and downstream of the internal volume 248. The nozzle cap 222 includes a complementary internal surface in abutment with the tapered surface 260. A number of grooves (recesses) 262 are disposed in the tapered surface 260 and extend from the internal volume 248 toward the nozzle orifice 236. When the complementary internal surface of the nozzle cap 222 is in abutment with the tapered surface 260, the grooves 262 provide fluid communication of the non-heated air from the internal volume 248 toward the nozzle orifice 236. The grooves terminate at an annular space 264 between a peripheral edge of the tapered surface 260 and the outer surface of the nozzle orifice 236, where the nozzle orifice 236 exits the nozzle 220. The annular space 264 is in fluid communication with the bore 266, whereby a suitably sized bore (larger than a diameter of the nozzle orifice 236) permits the non-heated air to exit the nozzle 220 and nozzle cap 222 under pressure. Preferably, the grooves 262 extend such that they terminate tangentially to the annular space 264 and thereby cause the non-heated air to produce a swirling fluid motion within the space 264 and in the vicinity of the nozzle orifice 236 after it has exited the bore 266.

The swirling fluid motion of the non-heated air, as it leaves the nozzle 220 and nozzle cap 222, imparts a swirling agitation to the plurality of wet particles/droplets 108 as they leave the nozzle 220. Such swirling agitation may suspend and agitate the wet particles/droplets 108 in order to achieve the aforementioned fission and evaporation. The above approach to atomization enables relatively high slurry throughput, on the order of 1-20 kg/hr at an input pressure of about 20-100 psi.

Figure 6:
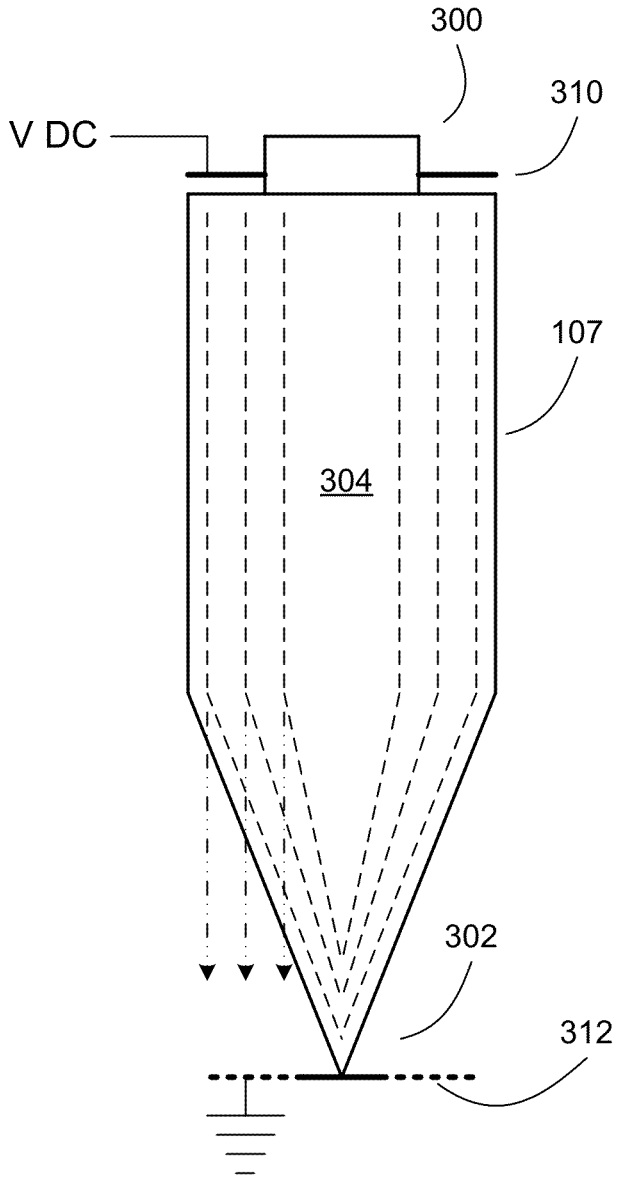
FIG. 6 is a schematic, side view of a drying chamber that may be employed in the system of FIG. 2 in accordance with one or more aspects of the present invention.

Reference is now made to FIG. 6, which is a schematic, side view of a drying chamber 107 that may be employed in the system 100 of FIG. 2 in accordance with one or more aspects of the present invention. The drying chamber 107 may include an inlet end 300, an outlet end 302, and an internal volume 304, within which the wet particles/droplets 108 are dried. The drying chamber is formed from a non-electrically conductive material. It is noted that the choice of materials (in this case a non-electrically conductive material, a non-metal) is not a mere matter of obvious design choice. Indeed, the conventional wisdom of the prior art spray drying process requires heated air (on the order of 200° C.), which consequently requires a metal drying chamber (typically stainless steel), otherwise the chamber would warp or otherwise fail.

A benefit of using non-heated air (which is directly counter to the conventional wisdom in the spray drying art) is that the drying chamber 107 may be formed from a non-metallic material; indeed, the temperature inside the drying chamber 107 may be less than 50° C. Thus, materials such as polymer-based composites may be employed for implementing the basic drying chamber 107. By way of example, filament wound fiberglass composite tanks (which are used for storage of water, various food stuffs, grain storage, brines and many non-food based applications) have excellent load carrying properties and can be used for making very large tanks. In one or more embodiments, such filament wound fiberglass composite materials may be used to fabricate the drying chamber 107 discussed herein. An advantage of using engineered plastics is the lower cost of the basic materials and the cost of manufacturing when compared to similar sized vessels made from stainless steel, for example. These materials also enable greater flexibility in the design of the drying chamber 107, making complex shapes possible, which are much more difficult and expensive to manufacture from stainless steel.

The use of non-metallic, non-conducting dielectric materials to form the drying chamber 107 (such as the engineered plastic composite materials), permits the use of one or more electric fields within the drying chamber 107 itself, to urge the particles/droplets 108 into desired trajectories and/or to urge such particles/droplets 108 from the inlet end 300 toward the outlet end 302 of the drying chamber 107. Notably, it is virtually impossible to develop an electric field inside a metallic, conductive vessel of the prior art because all charge accumulates on the surface of the vessel.

In accordance with one or more embodiments, the drying chamber 107 may include a first electrode 310 located at or near the inlet end 300 thereof, and a second electrode 312 located at or near the outlet end 302 of the drying chamber 107. The application of a source of voltage potential between the first and second electrodes 310, 312 induces an electric field (illustrated as broken lines) within the drying chamber 107 sufficient to urge the particles/droplets 108 into desired trajectories as they dry within the chamber 107. One such desirable trajectory is to cause the lines of the electric field to extend generally parallel to the walls of the drying chamber 107, even where such walls taper toward the outlet end 302.

To achieve such trajectory, the second electrode 312 would have to be of a relatively small diameter as compared to the first electrode 310 (as is depicted by only the solid portion of the line of the electrode 312.) If the first and second electrodes 310, 312 are of generally the same diameter, then the lines of the electric field would extend generally parallel to the walls of the drying chamber 107, and then pass through the tapered walls at the outlet end 302. Other particle trajectories may be achieved based on number, location, size, and shape of the electrodes. As illustrated, the first and second electrodes 310, 312 may be disposed external to the drying chamber 107, yet induce an electric field within the internal volume 304 of the drying chamber 107 by virtue of the formation thereof from non-electrically conductive material.

To illustrate the utility of the no heat spray drying process for probiotic applications, Dannon™ Aunatural plain yogurt was subject to spray drying process described herein. In order to show that the bacteria (called *L. acidophilus*) survived the process, the spray dried yogurt was used to produce a new culture of yogurt. Since yogurt is approximately 85% water by weight, a slurry was formed using 643 grams of starch M180 and 357 grams of yogurt to make a 1 kg batch of slurry. The starch to yogurt ratio was about 1.8. The slurry was subject to the no-heat drying process discussed above with respect to FIG. 2 and related illustrations. The resulting powder was then mixed with milk and a new yogurt culture was produced. A control culture using some of the original yogurt was also made. The spray dried bacteria produced the same amount of culture as the control using comparable starting weights of bacteria.

Figure 7:
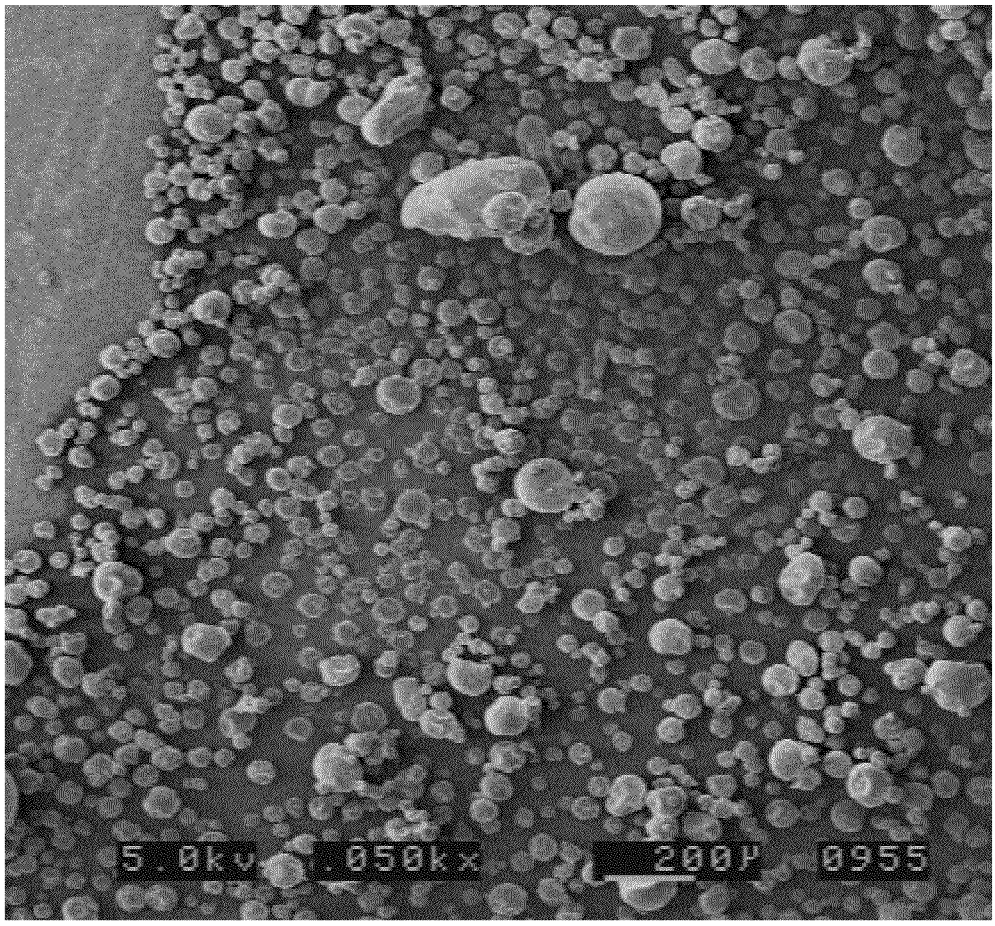
FIG. 7 is an image of dried powder non-fibrous particles produced using the system of FIG. 2.
Figure 8:
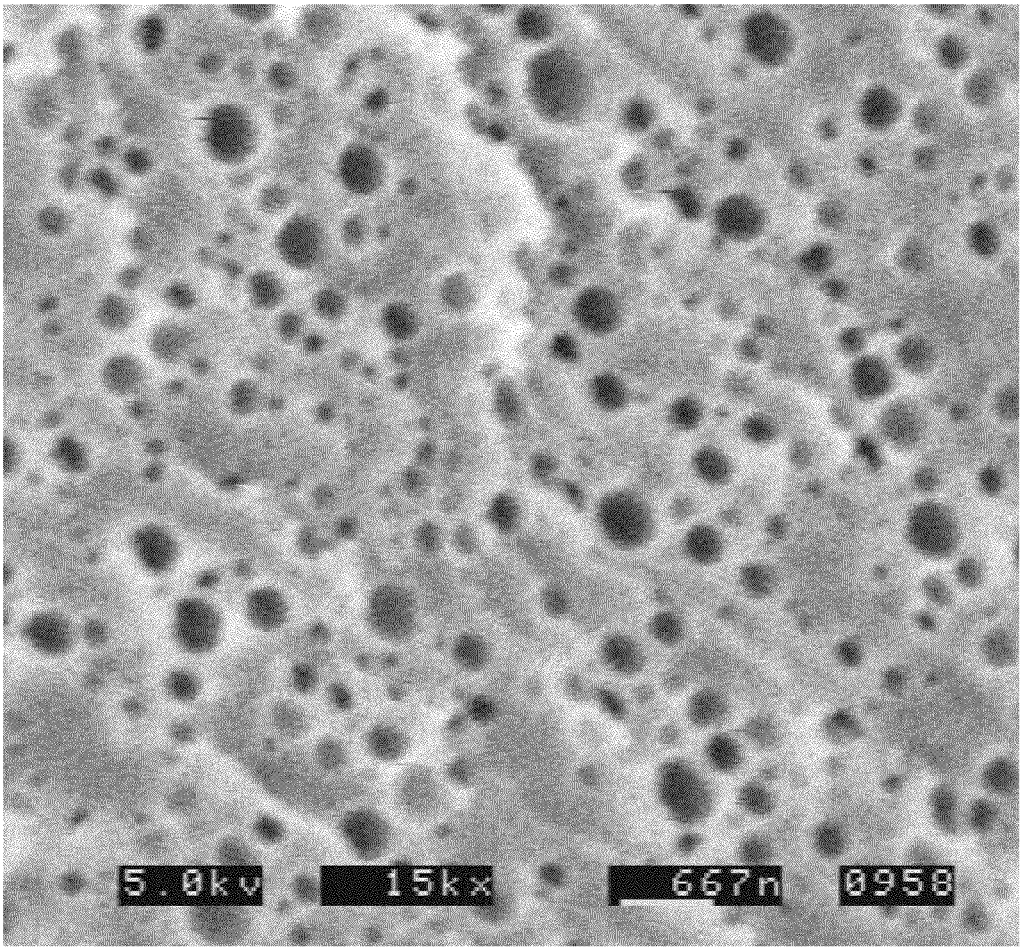
FIG. 8 is an image of a cross-section through one of the dried powder particles of FIG. 7 showing the encapsulation of the load within the carrier.

Reference is now made to FIGS. 7-8, which respectively are an image of dried powder non-fibrous particles produced using the system of FIG. 2, and a cross-section through one of the dried powder particles of FIG. 7. As can be seen in the scanning electron images, the dried particle morphology benefits from a no-heat process in that the particles do not experience an abrupt rise in temperature as they enter the drying chamber and the particles do not exhibit cracks on the surface, volcano structures on the surface, or hollow regions within the particles. The cross-section of the particle shows a uniform distribution of encapsulated constituent component(s), in this case flavor oil droplets, in the micron-diameter range.

Figure 9:
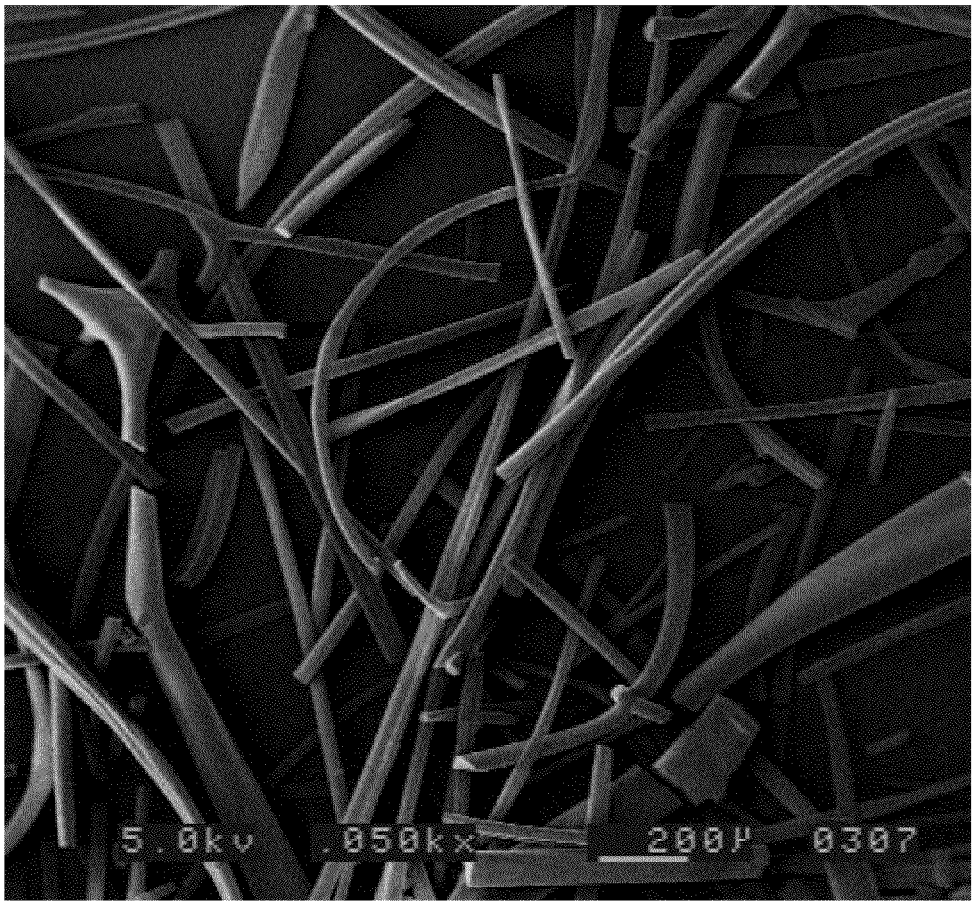
FIG. 9 is an image of dried powder fibers produced using the system of FIG. 2.
Figure 10:
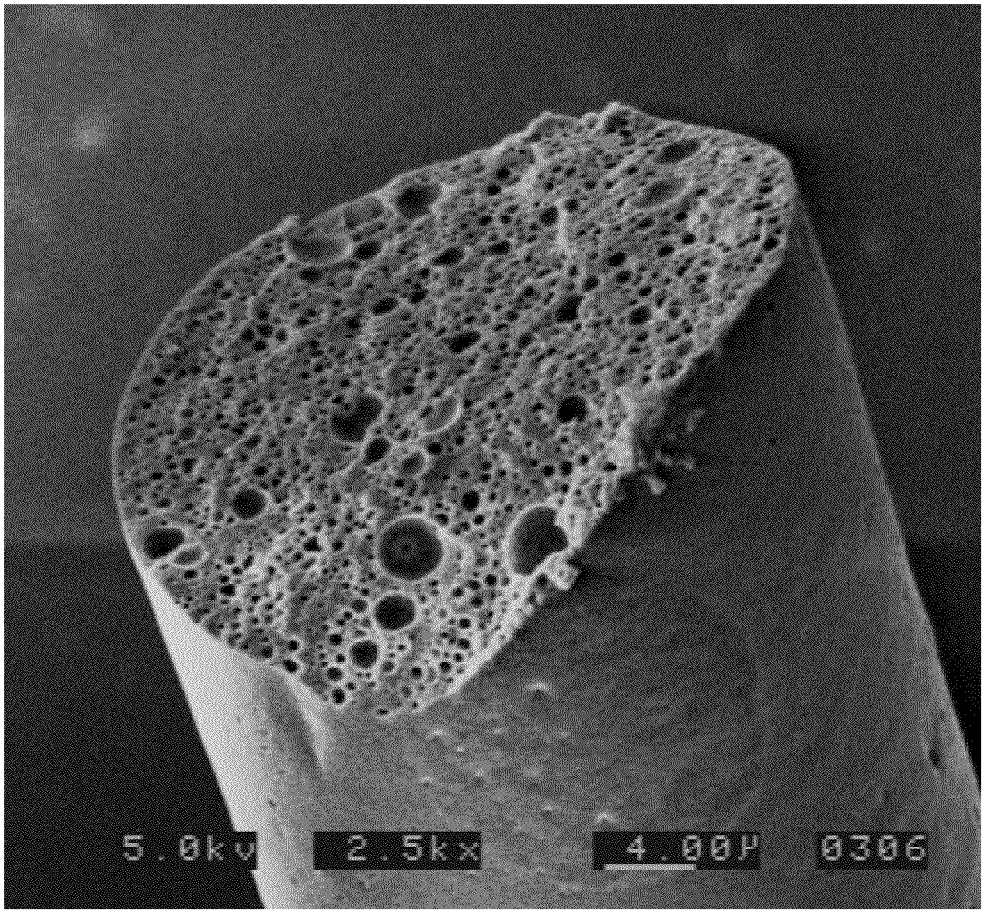
FIG. 10 is an image of a cross-section through one of the dried powder fibers of FIG. 9 showing the encapsulation of the load within the carrier.

Reference is now made to FIGS. 9-10, which respectively are scanning electron images of dried powder fibers produced using the system of FIG. 2, and a cross-section through one of the dried powder fibers. Through modifications of the emulsion of the slurry, it is also possible to produce fibers instead of particles. For example, to make fibers one may change the carrier material (e.g., the starch) to a lower DE (dextrose equivalent), such that the concentration level at which an "entanglement transition" occurs is crossed. At such concentration level, the large starch molecules interact in a manner such that the slurry begins to manifest extensional viscoelastic properties that permit fibers to form. As can be seen in the scanning electron images, the dried fiber morphology is also characterized by a lack of cracks on the surface, volcano structures on the surface, or hollow regions within the fibers. The cross-section of the fiber also shows a uniform distribution of encapsulated constituent component(s), in this case flavor oil droplets, in the micron-diameter range.

Figure 11:
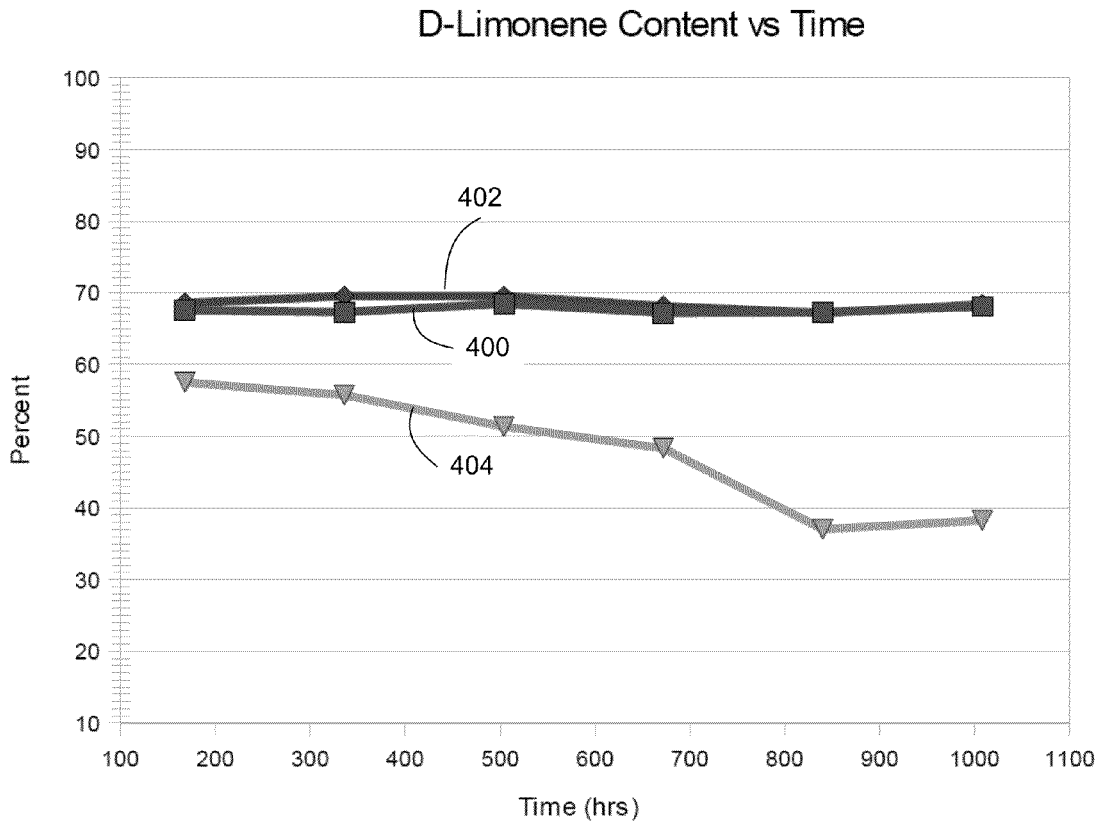
FIG. 11 is a graph illustrating certain properties of dried powder particles produced using the system of FIG. 2 as compared with the conventional spray drying process.

Reference is now made to FIG. 11, which is a graph illustrating the weight percentage of the desired component(s) within dried powder particles produced using the system of FIG. 2 as compared with the conventional spray drying process. The no-heat process has demonstrated higher levels of preservation of starting active ingredients such as volatile flavor molecules. FIG. 11 shows the results of a 1000 hour accelerated aging study (at elevated temperatures of about 95° F.) comparing powders produced by conventional spray dry processing and the no-heat process. In the illustrated results, amounts of a particular constituent component, in this case a principle molecular type called D-Limonene (obtained from orange oil), were measured in an un-processed source of flavor oil 400, dried powder 402 produced in accordance with the no-heat process described herein, and dried powder 404 produced in accordance with the prior art heated air process. As FIG. 11 clearly shows, the no-heat powder 402 retains essentially the same flavor oil composition as the original oil source 400 used to produce the starting slurry, whereas the conventionally spray dried powder 404 departs significantly from the original starting oil 400. Similar results were found for all other principal constituents of other flavor oils. Additionally, the appearance of degradation products was greatly diminished in the no-heat samples, resulting in longer projected shelf-life of the powder.

The above data reveal that not only are some of the structures and processes of the system 100 of FIG. 2 inventive, but the dried powder (or fiber) itself is inventive. Indeed, the resultant dried powder (or fiber) includes a plurality of dried particles/fibers, which individually contain an amount of final active ingredient encapsulated within a carrier resulting from drying the slurry, which contained an initial active ingredient, a liquid solvent and the carrier. The initial active ingredient includes one or more constituent components, at least one of which is among one or more principle molecular types from which at least one of a desirable food, flavor, fragrance, medicament, bacteria, probiotic, pigment, etc. is obtained. The final active ingredient includes one or more of the constituent components corresponding with those of the initial active ingredient as modified by the drying of the slurry. A weight percentage of at least one of the one or more principle molecular types in the final active ingredient is essentially the same (e.g., within about 5%, 4%, 3%, or 1% of a) weight percentage of the corresponding principle molecular types in the initial active ingredient.

Another way to characterize the inventive characteristics of the dried powder/fibers is that a weight percentage of at least one of the one or more principle molecular types in the active ingredient does not vary significantly (not by more than about 5%, 4%, 3%, 2%, or 1%) during aging of the dried powder during any period of elevated temperature of about 95° F. up to about 1000 hours.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A system for spray drying a liquid product into a dried powder, comprising:

a drying chamber, including an inlet end, an outlet end, and an internal volume within which the liquid product is dried in contact with a drying fluid therein;

an atomizer adapted to receive the liquid product in a form including a liquid solvent, a carrier, and an active ingredient, and to discharge atomized liquid product into the drying chamber for contact with the drying fluid to form the dried powder containing the active ingredient encapsulated within the carrier;

further comprising a source of said liquid solvent, a source of carrier, and a source of active ingredient(s), a tank equipped with a stirring device and arranged to receive liquid solvent, carrier, and active ingredient(s) from said sources to form the liquid product comprising a slurry having viscosity in a range of from 500 to 16,000 mPa-s, wherein the liquid solvent comprises water, wherein the carrier comprises starch, and wherein the drying fluid comprises air at temperature that is above freezing temperature of the liquid solvent and below 100° C.

2. A method for spray drying a liquid product into a dried powder without applying heat, comprising:

providing a system according to claim 1;

forming the liquid product as a slurry including a liquid solvent, a carrier, and an active ingredient;

applying an electrostatic charge to the slurry;

utilizing the atomizer, atomizing the charged slurry to produce a plurality of electrostatically charged, wet particles and discharging the electrostatically charged, wet particles into the drying chamber;

suspending the electrostatically charged, wet particles in the drying chamber in contact with the drying fluid for a sufficient time to permit repulsive forces induced by the electrostatic charge on at least some wet particles to cause at least some of such particles to divide into wet sub-particles; and continuing the suspending step in the drying chamber, without the presence of any heated drying fluids at temperature in a range of 180 to 200° C., for a sufficient time to drive off a sufficient amount of the liquid solvent within most of the wet particles to leave a plurality of dried particles in the dried powder, each dried particle containing the active ingredient encapsulated within the carrier.

3. The method for spray drying of claim 2, wherein the drying fluid comprises a non-heated drying fluid.

4. The method for spray drying of claim 3, wherein a temperature of the drying fluid is less than about 100° C. at introduction into the drying chamber.

5. The method for spray drying of claim 4, wherein the temperature of the drying fluid is at least one of: less than about 75° C. at introduction into the drying chamber; less than about 45° C. at introduction into the drying chamber; less than about 35° C. at introduction into the drying chamber; less than about 30° C. at introduction into the drying chamber; and at about an ambient temperature of a room within which the drying chamber is located.

6. The method for spray drying of claim 3, further comprising dehumidifying the drying fluid prior to introduction into the drying chamber.

7. The method for spray drying of claim 3, further comprising applying the drying fluid under pressure to suspend and agitate the wet particles within the drying chamber.

8. The method for spray drying of claim 3, further comprising applying the drying fluid under pressure and in one or more direction to impart a swirling motion to the wet particles within the drying chamber.

9. The method for spray drying of claim 3, further comprising applying one or more electric fields within the drying chamber to urge at least one of the wet particles and the dried particles to travel in a direction defined from an inlet end of the drying chamber to an outlet end of the drying chamber.

10. The method for spray drying of claim 2, further comprising controlling a viscosity of the slurry during formation such that the viscosity of the slurry at the atomization step is at least one of: greater than about 300 mPa-s; greater than about 350 mPa-s; greater than about 400 mPa-s; greater than about 500 mPa-s; greater than about 600 mPa-s; greater than about 700 mPa-s; between about 500-16,000 mPa-s; and between about 1000-4000 mPa-s.

11. The method for spray drying of claim 2, wherein the liquid solvent comprises water, said method further comprising controlling a ratio of water within the slurry during formation such that the ratio of water within the slurry at the atomization step is at least one of: between about 20-50 weight percentage; between about 20-45 weight percentage; between about 20-45 weight percentage; between about 20-40 weight percentage; about 30 weight percentage.

12. The method for spray drying of claim 2, wherein the step of atomizing is carried out using at least one of: a nozzle technique, a centrifugal technique, a pneumatic technique, and an ultrasonic technique.

13. The method for spray drying of claim 2, wherein at least one of:

the active ingredient includes at least one of foods, flavors, fragrances, medicaments, pigments, probiotics, bacteria;

the carrier includes a modified starch; and the liquid solvent includes water.

14. The system of claim 1, further comprising:

a first electrode located at or near the inlet end of the drying chamber; and a second electrode located at or near the outlet end of the drying chamber, wherein application of a source of voltage potential between the first and second electrodes induces an electric field within the drying chamber sufficient to urge particles of the liquid product, produced by way of atomization, from the inlet end toward the outlet end of the drying chamber.

15. The system of claim 14, wherein the first and second electrodes are disposed external to the drying chamber, yet induce an electric field within the internal volume of the drying chamber by virtue of the formation of the drying chamber from the non-electrically conductive material.

16. The system of claim 1, wherein the atomizer comprises:

a nozzle operating to atomize the liquid product comprising a slurry to produce a plurality of wet particles as said atomized liquid product discharged into the drying chamber for contact with the drying fluid.

17. The system of claim 16, further comprising at least one electrode operating to contact the slurry and apply an electrostatic charge thereto, such that the nozzle operates to produce a plurality of electrostatically charged wet particles.

18. The system of claim 17, wherein the at least one electrode is disposed within the nozzle such that the slurry contacts the electrode and becomes electrostatically charged while flowing from an inlet end to an outlet end of the nozzle.

19. The system of claim 16, wherein the nozzle includes an inlet for receiving a source of pressurized, drying fluid and an outlet end including a plurality of channels operating to direct the drying fluid to swirl as it leaves the nozzle, thereby imparting a swirling agitation to the plurality of wet particles as they leave the nozzle.

20. A dried powder, comprising:

a plurality of dried particles formed by the method of claim 2, which individually contain an amount of final active ingredient encapsulated within the carrier resulting from drying the slurry containing initial active ingredient, the liquid solvent and the carrier, wherein:

the initial active ingredient includes one or more constituent components, at least one of which is among one or more principle molecular types from which at least one of a desirable food, flavor, fragrance, medicament, and pigment is obtained;

the final active ingredient includes one or more of the constituent components corresponding with those of the initial active ingredient as modified by the drying of the slurry; and a weight percentage of at least one of the one or more principle molecular types in the final active ingredient is within about 5% of a weight percentage of the corresponding principle molecular types in the initial active ingredient.

21. The dried powder of claim 20, wherein the weight percentage of at least one of the one or more principle molecular types in the final active ingredient is within about 3% of a weight percentage of the corresponding principle molecular types in the initial active ingredient.

22. The dried powder of claim 20, wherein the weight percentage of at least one of the one or more principle molecular types in the final active ingredient is within about 2% of a weight percentage of the corresponding principle molecular types in the initial active ingredient.

23. The dried powder of claim 20, wherein the weight percentage of at least one of the one or more principle molecular types in the final active ingredient is within about 1% of a weight percentage of the corresponding principle molecular types in the initial active ingredient.

24. A dried powder, comprising:

a plurality of dried particles formed by the method of claim 2, which individually contain an amount of the active ingredient encapsulated within the carrier, wherein:

the active ingredient includes one or more constituent components, at least one of which is among one or more principle molecular types from which at least one of a desirable food, flavor, fragrance, medicament, and pigment is obtained; and a weight percentage of at least one of the one or more principle molecular types in the active ingredient does not vary by more than about 5% during aging of the dried powder during any period of elevated temperature of about 95° F. up to about 1000 hours.

25. The dried powder of claim 24, wherein the weight percentage of at least one of the one or more principle molecular types in the active ingredient does not vary by more than about 3% during aging of the dried during any period of elevated temperature of about 95° F. up to about 1000 hours.

26. The dried powder of claim 24, wherein the weight percentage of at least one of the one or more principle molecular types in the active ingredient does not vary by more than about 2% during aging of the dried during any period of elevated temperature of about 95° F. up to about 1000 hours.

27. The dried powder of claim 24, wherein the weight percentage of at least one of the one or more principle molecular types in the active ingredient does not vary by more than about 1% during aging of the dried during any period of elevated temperature of about 95° F. up to about 1000 hours.

28. The system of claim 1, further comprising a source of said liquid solvent, a source of carrier, and a source of active ingredient(s), a tank equipped with a stirring device and arranged to receive liquid solvent, carrier, and active ingredient(s) from said sources to form the liquid product comprising a slurry having viscosity in a range of from 500 to 16,000 mPa-s, wherein the liquid solvent comprises water, wherein the carrier comprises starch, and wherein the drying fluid comprises air at temperature that is above freezing temperature of the liquid solvent and below 100° C.

29. A method of forming a dry powder comprising an active ingredient encapsulated within a carrier, said method comprising:

providing a system according to claim 28;

forming the slurry in the mixing tank from the liquid solvent, carrier, and active ingredient(s) while stirring the mixing tank with the stirring device;

atomizing the slurry in the atomizer and discharging atomized slurry into the drying chamber for contact with the drying fluid to form the dried powder containing the active ingredient encapsulated within the carrier.

30. A dried powder containing an active ingredient encapsulated within a carrier, formed by the method of claim 29.

31. The system of claim 1, wherein the drying chamber is formed from a non-electrically conductive material.

* * * * *

UNITED STATES PATENT AND TRADEMARK OFFICE

CERTIFICATE OF CORRECTION

PATENT NO. : 8,939,388 B1
APPLICATION NO. : 13/245369
DATED : January 27, 2015
INVENTOR(S) : Beetz et al.

It is certified that error appears in the above-identified patent and that said Letters Patent is hereby corrected as shown below:

In the Specification

Column 8, lines 14-15: delete "(e.g., the feed pump of FIG. 2)" and insert -- (e.g., the feed pump 5 of FIG. 2)" --.

In the Claims

Column 16, lines 14-23: Claim 28, delete

> "28. The system of claim 1, further comprising a dehumidifier arranged to dehumidify the drying fluid prior to its flow through the drying chamber source of said liquid solvent, a source of carrier, and a source of active ingredient(s), a tank equipped with a stirring device and arranged to receive liquid solvent, carrier, and active ingredient(s) from said sources to form the liquid product comprising a slurry having viscosity in a range of from 500 to 16,000 mPa-s, wherein the liquid solvent comprises water, wherein the carrier comprises starch, and wherein the drying fluid comprises air at temperature that is above freezing temperature of the liquid solvent and below 100°C."

and insert

-- 28. The system of claim 1, further comprising a dehumidifier arranged to dehumidify the drying fluid prior to its flow through the drying chamber. --.

Signed and Sealed this
Fifteenth Day of September, 2015

Michelle K. Lee

Michelle K. Lee
*Director of the United States Patent and Trademark Office*